US011721922B2

(12) United States Patent
Mamuro et al.

(10) Patent No.: US 11,721,922 B2
(45) Date of Patent: Aug. 8, 2023

(54) MULTIPOLE CONNECTOR SET

(71) Applicant: Murata Manufacturing Co., Ltd., Kyoto-fu (JP)

(72) Inventors: Minoru Mamuro, Nagaokakyo (JP); Daisuke Okubo, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 211 days.

(21) Appl. No.: 17/385,573

(22) Filed: Jul. 26, 2021

(65) Prior Publication Data

US 2021/0359443 A1 Nov. 18, 2021

Related U.S. Application Data

(63) Continuation of application No. PCT/JP2020/013487, filed on Mar. 25, 2020.

(30) Foreign Application Priority Data

Mar. 28, 2019 (JP) ..... 2019-062500

(51) Int. Cl.
*H01R 13/648* (2006.01)
*H01R 12/71* (2011.01)
(Continued)

(52) U.S. Cl.
CPC ..... *H01R 12/716* (2013.01); *H01R 13/6471* (2013.01); *H01R 13/6585* (2013.01); *H01R 13/6594* (2013.01); *H01R 2107/00* (2013.01)

(58) Field of Classification Search
CPC .... H01R 12/71; H01R 12/712; H01R 12/716; H01R 13/6471; H01R 13/6585; H01R 13/6594; H01R 2107/00
(Continued)

(56) References Cited

U.S. PATENT DOCUMENTS 11,495,919 B2 * 11/2022 Oosaka ..... H01R 13/6586
2021/0359443 A1 * 11/2021 Mamuro ..... H01R 12/716

FOREIGN PATENT DOCUMENTS

JP H05-045965 A 2/1993
JP H09-180822 A 7/1997
(Continued)

OTHER PUBLICATIONS

International Search Report issued in PCT/JP2020/013487; dated Jun. 16, 2020.
(Continued)

*Primary Examiner* — Khiem M Nguyen
(74) *Attorney, Agent, or Firm* — Studebaker & Brackett PC

(57) ABSTRACT

When a multipole connector set is viewed from a height direction and when a first ground terminal assembly, a first signal terminal assembly, and a second ground terminal assembly are arranged in a length direction as follows: A connection portion at the outermost side in a width direction of the first ground terminal assembly is a first connection portion, a connection portion at the outermost side in the width direction of the second ground terminal assembly is a second connection portion, a connection portion arranged at the innermost side in the width direction of the first ground terminal assembly is a third connection portion, and a connection portion at the innermost side in the width direction of the second ground terminal assembly is a fourth connection portion. All connection portions of the first signal terminal assemblies are inside a quadrangle connecting the first, second, third and fourth connection portions.

20 Claims, 16 Drawing Sheets

(51) Int. Cl.

| | |
|---|---|
| ***H01R 13/6471*** | (2011.01) |
| ***H01R 13/6585*** | (2011.01) |
| ***H01R 13/6594*** | (2011.01) |
| *H01R 107/00* | (2006.01) |

(58) Field of Classification Search
USPC ..... 439/65, 607.05
See application file for complete search history.

(56) References Cited

FOREIGN PATENT DOCUMENTS

| | | | |
|---|---|---|---|
| JP | 2000-067956 | A | 3/2000 |
| JP | 2003-317874 | A | 11/2003 |
| JP | 2018-116925 | A | 7/2018 |
| WO | 2018/025875 | A1 | 2/2018 |

OTHER PUBLICATIONS

Written Opinion of the International Searching Authority issued in PCT/JP2020/013487; dated Jun. 16, 2020.

* cited by examiner

MULTIPOLE CONNECTOR SET

CROSS-REFERENCE TO RELATED APPLICATIONS

This application claims benefit of priority to International Patent Application No. PCT/JP2020/013487, filed Mar. 25, 2020, and to Japanese Patent Application No. 2019-062500, filed Mar. 28, 2019, the entire contents of each are incorporated herein by reference.

BACKGROUND

Technical Field

The present disclosure relates to a multipole connector set composed by mating a first connector with a second connector.

Background Art

Multipole connector sets have hitherto been known, each of which is composed by mating a first connector connected to one circuit board, among two circuit boards, with a second connector connected to the other circuit board to electrically connect the two circuit boards to each other as described, for example, in Japanese Unexamined Patent Application Publication No. 2018-116925.

The multipole connector set in Japanese Unexamined Patent Application Publication No. 2018-116925 has shielding members (external terminals) provided on side faces to suppress intrusion and radiation of noise.

SUMMARY

However, the intrusion and radiation of noise may not be sufficiently suppressed by using shielding structures in the related art with signals of increasingly higher frequencies being transmitted.

Accordingly, the present disclosure provides a multipole connector set. The multipole connector set is a connector set which includes many terminals and in which intrusion of noise from the outside and radiation of noise to the outside are suppressed.

A multipole connector set according to an embodiment of the present disclosure is composed by mating a first connector with a second connector. When a length direction, a width direction, and a height direction that are perpendicular to each other are defined for each of the first connector, the second connector, and the multipole connector set in a state in which the first connector is mated with the second connector, the first connector includes multiple first terminals extended in the width direction and a first insulating member holding the first terminals. The multiple first terminals are allocated in a first column and a second column, which extend in the length direction. The first terminals include first signal terminals connected to signal lines and first ground terminals that are grounded. The second connector includes multiple second terminals extended in the width direction and a second insulating member holding the second terminals. The multiple second terminals is allocated in a first column and a second column, which extend in the length direction, and the second terminals include second signal terminals connected to signal lines and second ground terminals that are grounded. In the state in which the first connector is mated with the second connector, each first signal terminal is connected to the corresponding second signal terminal to compose a signal terminal assembly, each first ground terminal is connected to the corresponding second ground terminal to compose a ground terminal assembly, the first signal terminal is connected to the second signal terminal with at least one connection portion in each signal terminal assembly, and the first ground terminal is connected to the second ground terminal with at least two connection portions in each ground terminal assembly. When the multipole connector set is viewed from the height direction and when one first ground terminal assembly selected from the ground terminal assemblies, one or two or more first signal terminal assemblies selected from the signal terminal assemblies, and another second ground terminal assembly selected from the ground terminal assemblies are arranged in the length direction as follows. The connection portion arranged at the outermost side in the width direction of the first ground terminal assembly is referred to as a first connection portion. The connection portion arranged at the outermost side in the width direction of the second ground terminal assembly is referred to as a second connection portion. The connection portion arranged at the innermost side in the width direction of the first ground terminal assembly is referred to as a third connection portion, and the connection portion arranged at the innermost side in the width direction of the second ground terminal assembly is referred to as a fourth connection portion. All the connection portions of the first signal terminal assemblies are arranged inside a quadrangle connecting the first connection portion, the second connection portion, the third connection portion, and the fourth connection portion.

With the multipole connector set according to the embodiment of the present disclosure, intrusion of noise from the outside and radiation of noise to the outside are suppressed.

DETAILED DESCRIPTION

Figure 1A:
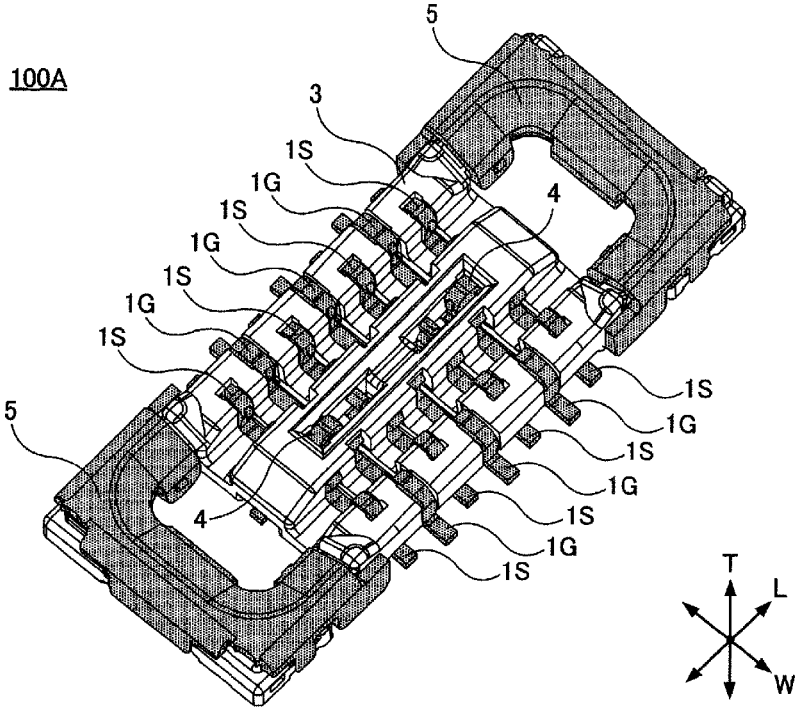
FIG. 1A is a perspective view of a first connector when the first connector is viewed from a mating face side.

Embodiments of the present disclosure will herein be described with reference to the drawings.

The respective embodiments are only examples and the present disclosure is not restricted by the content of the embodiments. The content described in different embodiments may be combined and the content embodied in such cases is also included in the present disclosure. The drawings are illustrated for help of understanding the description and may be schematically illustrated. Components that are illustrated or the ratio of the sizes of the components may not coincide with the ratio of the sizes of the components that are described in the description. In addition, the components described in the description may be omitted in the drawings or the number of the components may be decreased for illustration.

FIRST EMBODIMENT; MULTIPOLE CONNECTOR SET 100

Figure 1B:
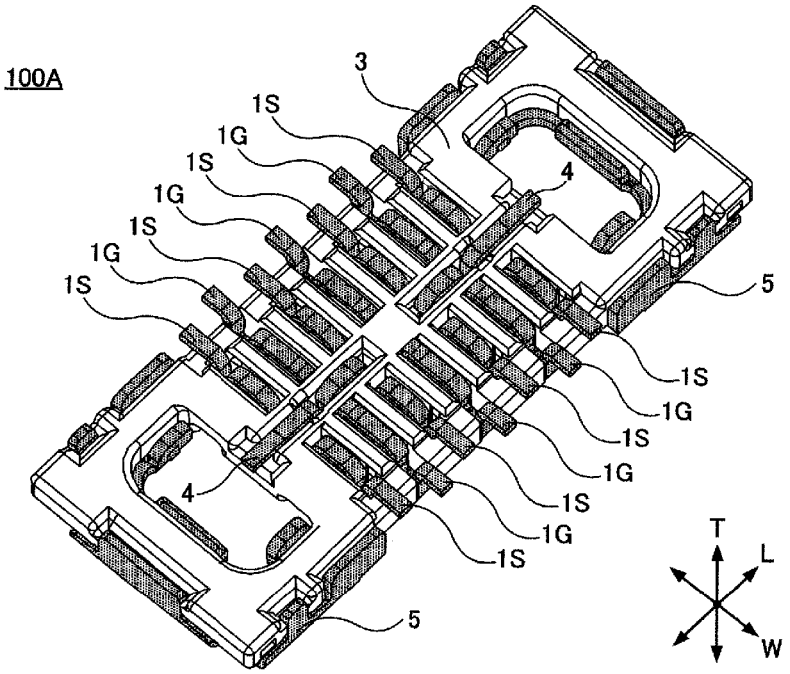
FIG. 1B is a perspective view of the first connector when the first connector is viewed from a mounting face side.
Figure 2:
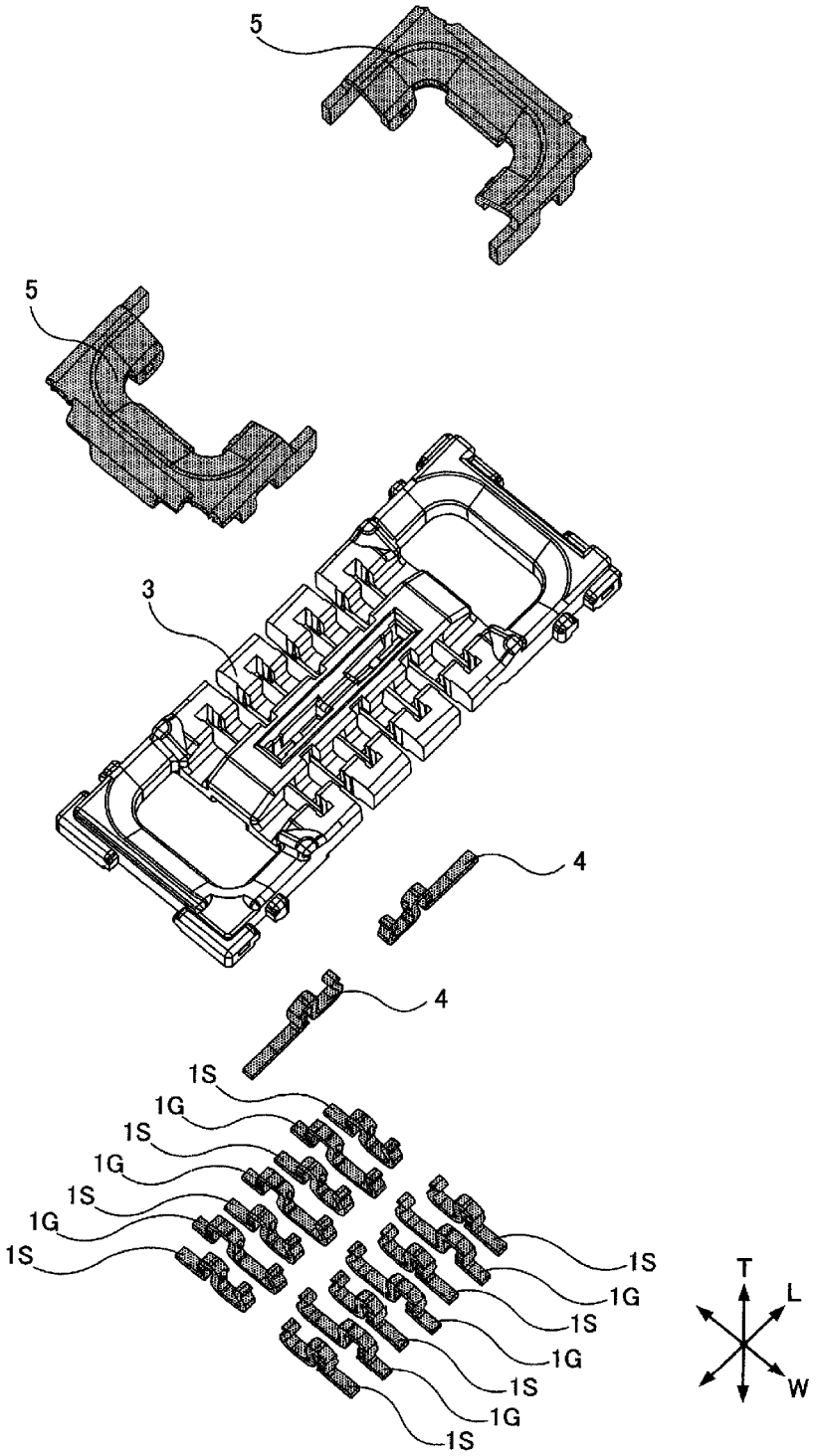
FIG. 2 is an exploded perspective view of the first connector.
Figure 3A:
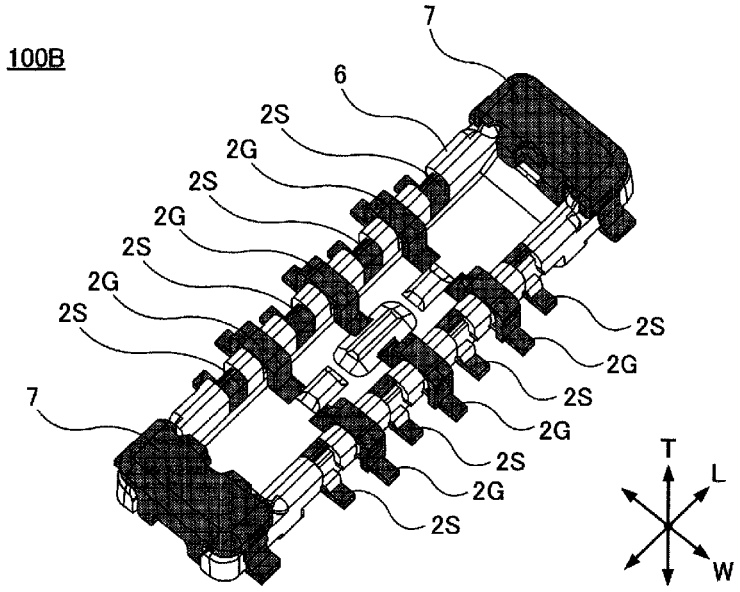
FIG. 3A is a perspective view of a second connector when the second connector is viewed from the mating face side.
Figure 3B:
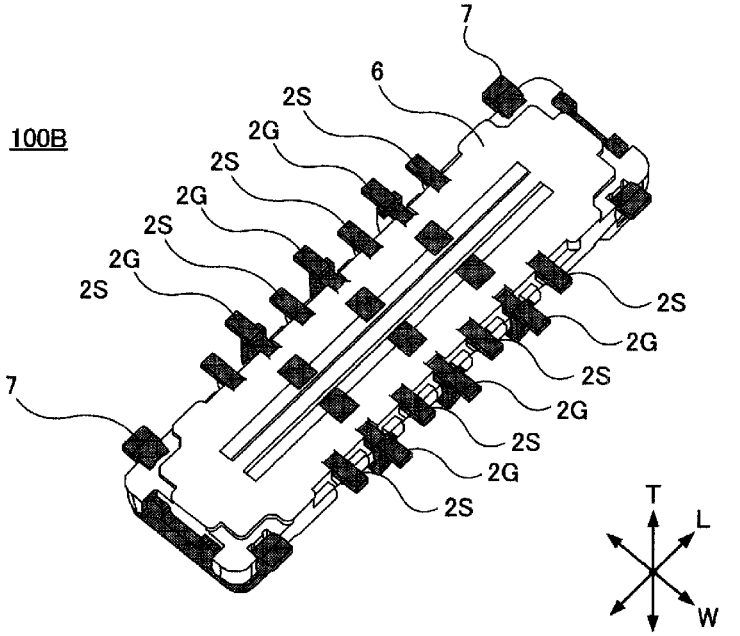
FIG. 3B is a perspective view of the second connector when the second connector is viewed from the mounting face side.
Figure 4:
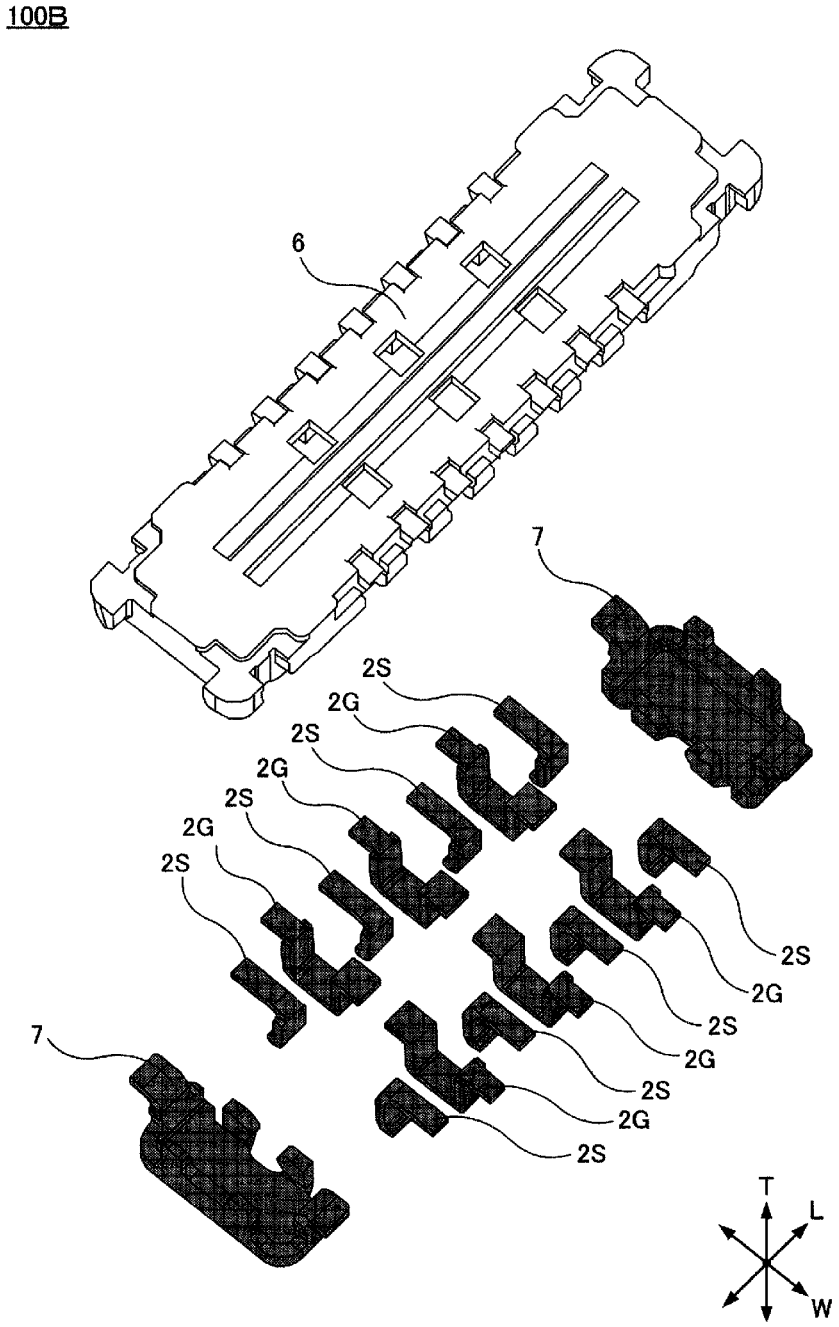
FIG. 4 is an exploded perspective view of the second connector.
Figure 5:
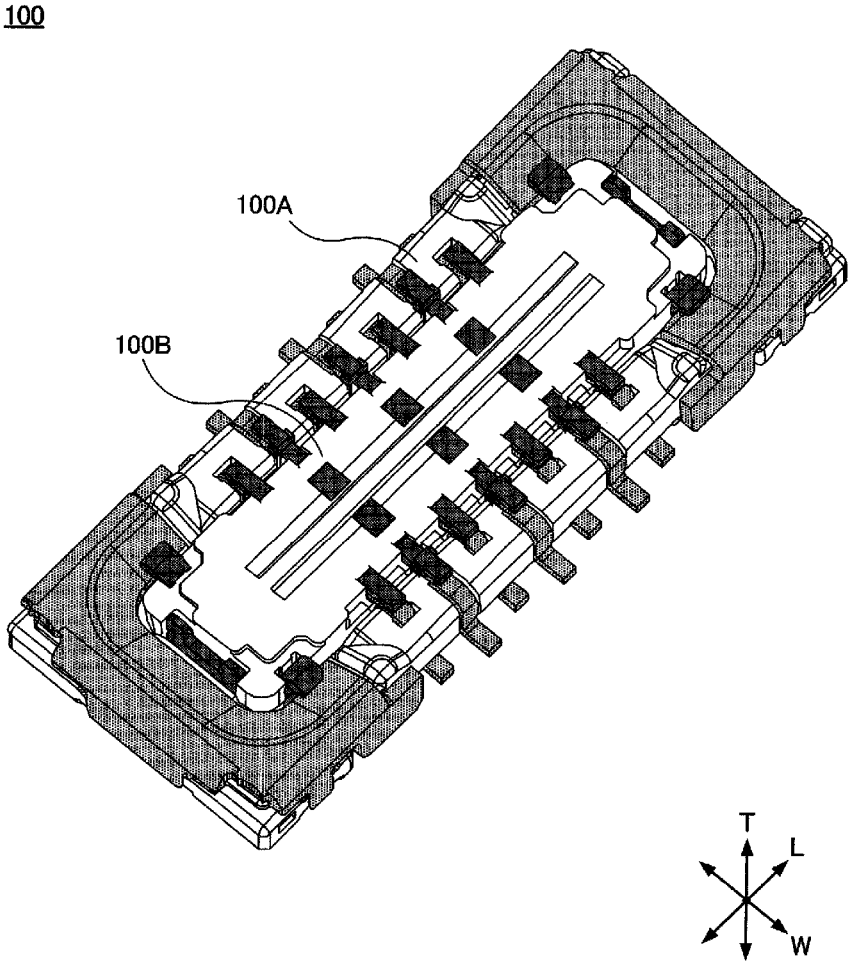
FIG. 5 is a perspective view of a multipole connector set.
Figure 6:
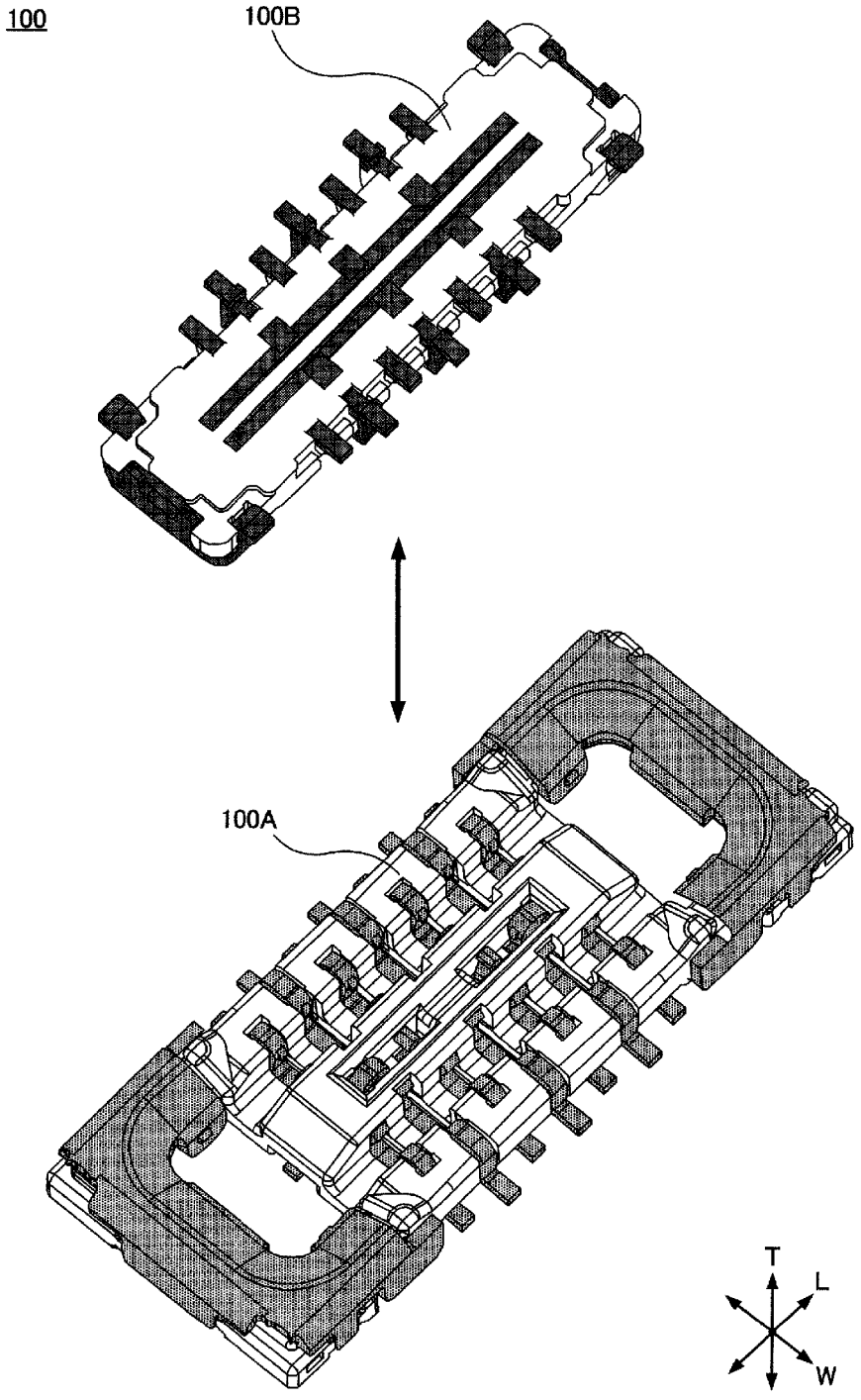
FIG. 6 is a perspective view of the multipole connector set in which the mating of the first connector with the second connector is released.

FIG. 1A, FIG. 1B, FIG. 2, FIG. 3A, FIG. 3B, FIG. 4, FIG. 5, and FIG. 6 illustrate a multipole connector set 100 according to a first embodiment. The multipole connector set 100 is composed by mating a first connector 100A with a second connector 100B. FIG. 1A is a perspective view of the first connector 100A when the first connector 100A is viewed from a mating face side. FIG. 1B is a perspective view of the first connector 100A when the first connector 100A is viewed from a mounting face side. FIG. 2 is an exploded perspective view of the first connector 100A. FIG. 3A is a perspective view of the second connector 100B when the second connector 100B is viewed from the mating face side. FIG. 3B is a perspective view of the second connector 100B when the second connector 100B is viewed from the mounting face side. FIG. 4 is an exploded perspective view of the second connector 100B. FIG. 5 is a perspective view of the multipole connector set 100. FIG. 6 is a perspective view of the multipole connector set 100 in which the mating of the first connector 100A with the second connector 100B is released.

A height direction T, a length direction L, and a width direction W of the multipole connector set 100, the first connector 100A, and the second connector 100B are illustrated in the drawings and these directions may be referred to in the following description. The multipole connector set 100, the first connector 100A, and the second connector 100B each have the mounting face and the mating face with respect to the height direction T, a pair of end faces with respect to the length direction L, and a pair of side faces with respect to the width direction W.

As described above, the multipole connector set 100 is composed by mating the first connector 100A with the second connector 100B. The first connector 100A, the second connector 100B, and the multipole connector set 100 will be sequentially described.

<First Connector 100A>

FIG. 1A, FIG. 1B, and FIG. 2 illustrate the first connector 100A.

The first connector 100A includes multiple first terminals composed of multiple first signal terminals 1S and multiple first ground terminals 1G. The first signal terminals 1S are connected to signal lines on a circuit board or the like having the first connector 100A mounted thereon. The first ground terminals 1G are grounded through the circuit board or the like having the first connector 100A mounted thereon.

Figure 7A:
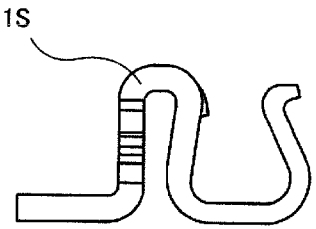
FIG. 7A is a side view of a first signal terminal.
Figure 7B:
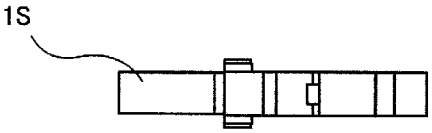
FIG. 7B is a plan view of the first signal terminal.
Figure 7C:
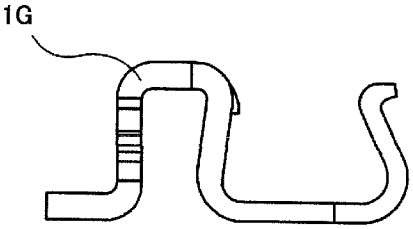
FIG. 7C is a side view of a first ground terminal.
Figure 7D:
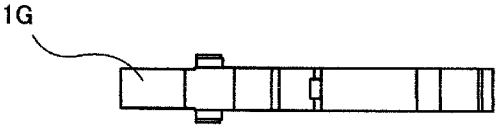
FIG. 7D is a plan view of the first ground terminal.

FIG. 7A is a side view of the first signal terminal 1S. FIG. 7B is a plan view of the first signal terminal 1S. FIG. 7C is a side view of the first ground terminal 1G. FIG. 7D is a plan view of the first ground terminal 1G.

In the present embodiment, each of the first signal terminal 1S and the first ground terminal 1G is manufactured by bending a strip-shaped metal plate. Although the first signal terminals 1S and the first ground terminals 1G may be made of an arbitrary material, for example, phosphor bronze may be used for the first signal terminals 1S and the first ground terminals 1G. Phosphor bronze is an elastic deformable material having electrical conductivity. The first signal terminals 1S and the first ground terminals 1G may be formed through die cutting of a metallic member having a spring property.

The first connector 100A includes a first insulating member 3. The first insulating member 3 is a member for holding the first signal terminals 1S and the first ground terminals 1G. Although the first insulating member 3 may be made of an arbitrary material, for example, resin may be used for the first insulating member 3. The first signal terminals 1S and the first ground terminals 1G are subjected to insert molding into the first insulating member 3. The first signal terminals 1S and the first ground terminals 1G may be fit into the first insulating member 3 to be fixed to the first insulating member 3.

The first signal terminals 1S and the first ground terminals 1G are each extended from the first insulating member 3 in the width direction W.

Figure 8:
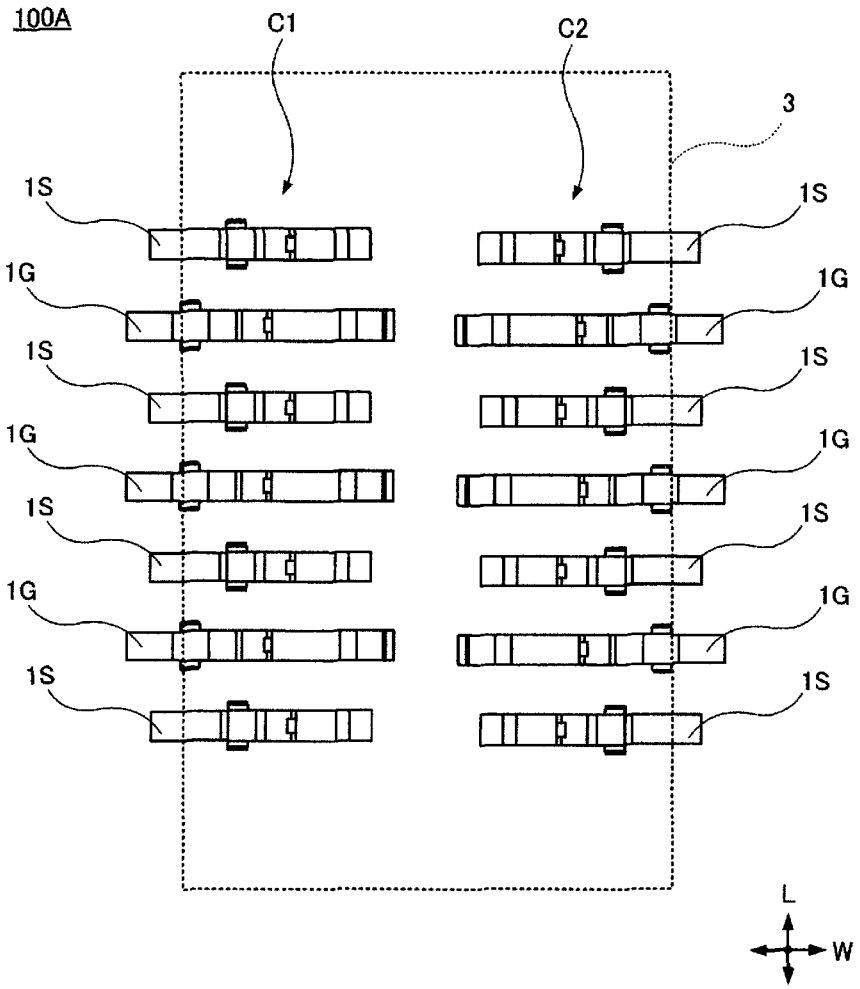
FIG. 8 is an explanatory diagram illustrating how the first signal terminals and the first ground terminals are arranged.

The first signal terminals 1S and the first ground terminals 1G are allocated in a first column C1 and a second column C2, which extend in the length direction L, as illustrated in FIG. 8.

The four first signal terminals 1S and the three first ground terminals 1G are alternately arranged in the first column C1. The first signal terminal 1S is arranged at the forefront of the first column C1. The four first signal terminals 1S and the three first ground terminals 1G are alternately arranged also in the second column C2. The first signal terminal 1S is arranged at the forefront of the second column C2.

The first connector 100A includes center shielding members 4. The center shielding members 4 prevents interference of electromagnetic waves between the first signal terminals 1S arranged in the first column C1 and the first signal terminals 1S arranged in the second column C2. In addition, the center shielding members 4 improve isolation between the first signal terminals 1S arranged in the first column C1 and the first signal terminals 1S arranged in the second column C2. The center shielding members 4 are grounded through the circuit board or the like having the first connector 100A mounted thereon. The center shielding members 4 are subjected to insert molding into the first insulating member 3. Although the center shielding members 4 may be made of an arbitrary material, for example, phosphor bronze may be used for the first external terminals 5.

The first connector 100A includes a pair of first external terminals 5. The first external terminals 5 shield the end faces of the first connector 100A. The first external terminals 5 are grounded through the circuit board or the like having the first connector 100A mounted thereon. The first external terminals 5 are subjected to insert molding into both end portions of the first insulating member 3. Although the first external terminals 5 may be made of an arbitrary material, for example, phosphor bronze may be used for the first external terminals 5. The first external terminals 5 may be fit into the first insulating member 3 to be fixed to the first insulating member 3.

<Second Connector 100B>

FIG. 3A, FIG. 3B, and FIG. 4 illustrate the second connector 100B.

The second connector 100B includes multiple second terminals composed of multiple second signal terminals 2S and multiple second ground terminals 2G. The second signal terminals 2S are connected to the signal lines on the circuit board or the like having the second connector 100B mounted thereon. The second ground terminals 2G are grounded through the circuit board or the like having the second connector 100B mounted thereon.

Figure 9B:
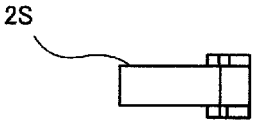
FIG. 9B is a plan view of the second signal terminal.
Figure 9D:
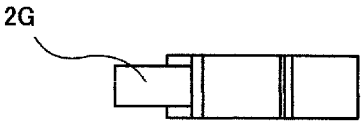
FIG. 9D is a plan view of the second ground terminal.
Figure 9A:
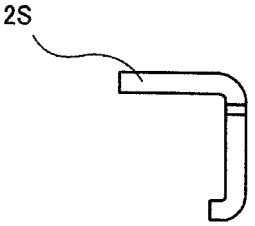
FIG. 9A is a side view of a second signal terminal.
Figure 9C:
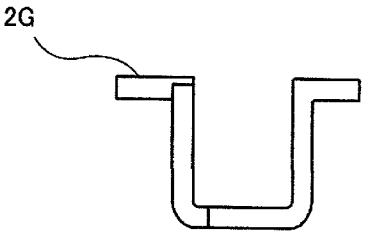
FIG. 9C is a side view of a second ground terminal.

FIG. 9A is a side view of the second signal terminal 2S. FIG. 9B is a plan view of the second signal terminal 2S. FIG. 9C is a side view of the second ground terminal 2G. FIG. 9D is a plan view of the second ground terminal 2G.

In the present embodiment, each of the second signal terminal 2S and the second ground terminal 2G is manufactured by bending a strip-shaped metal plate. Although the second signal terminals 2S and the second ground terminals 2G may be made of an arbitrary material, for example, phosphor bronze may be used for the second signal terminals 2S and the second ground terminals 2G.

The second connector 100B includes a second insulating member 6. The second insulating member 6 is a member for holding the second signal terminals 2S and the second ground terminals 2G. Although the second insulating member 6 may be made of an arbitrary material, for example, resin may be used for the second insulating member 6. The second signal terminals 2S and the second ground terminals 2G are subjected to insert molding into the second insulating member 6.

The second signal terminals 2S and the second ground terminals 2G are each extended from the second insulating member 6 in the width direction W.

Figure 10:
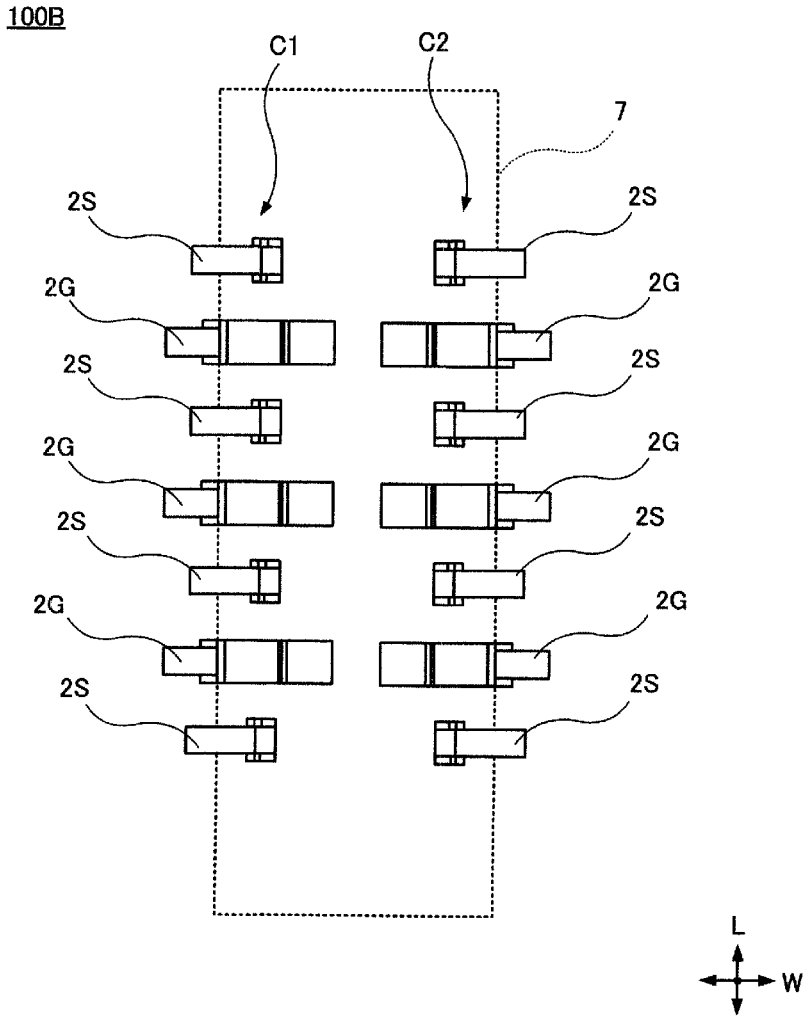
FIG. 10 is an explanatory diagram illustrating how the second signal terminals and the second ground terminals are arranged.

The second signal terminals 2S and the second ground terminals 2G are allocated in the first column C1 and the second column C2, which extend in the length direction L, as illustrated in FIG. 10.

The four first second signal terminals 2S and the three second ground terminals 2G are alternately arranged in the first column C1. The four second signal terminals 2S and the three second ground terminals 2G are alternately arranged also in the second column C2.

The second connector 100B includes a pair of second external terminals 7. The second external terminals 7 shield the end faces of the second connector 100B. The second external terminals 7 are grounded through the circuit board or the like having the second connector 100B mounted thereon. The second external terminals 7 are subjected to insert molding into both end portions of the second insulating member 6. Although the second external terminals 7 may be made of an arbitrary material, for example, phosphor bronze may be used for the second external terminals 7. The second external terminals 7 may be fit into the second insulating member 6 to be fixed to the first insulating member 3.

<Multipole Connector Set 100>

The first connector 100A is mated with the second connector 100B to compose the multipole connector set 100. FIG. 5 illustrates a state in which the first connector 100A is mated with the second connector 100B. FIG. 6 illustrates a state in which the mating of the first connector 100A with the second connector 100B is released.

In the state in which the first connector 100A is mated with the second connector 100B, each first signal terminal 1S is connected to the corresponding second signal terminal 2S to compose a signal terminal assembly CS and each first ground terminal 1G is connected to the corresponding second ground terminal 2G to compose a ground terminal assembly CG.

Figure 11:
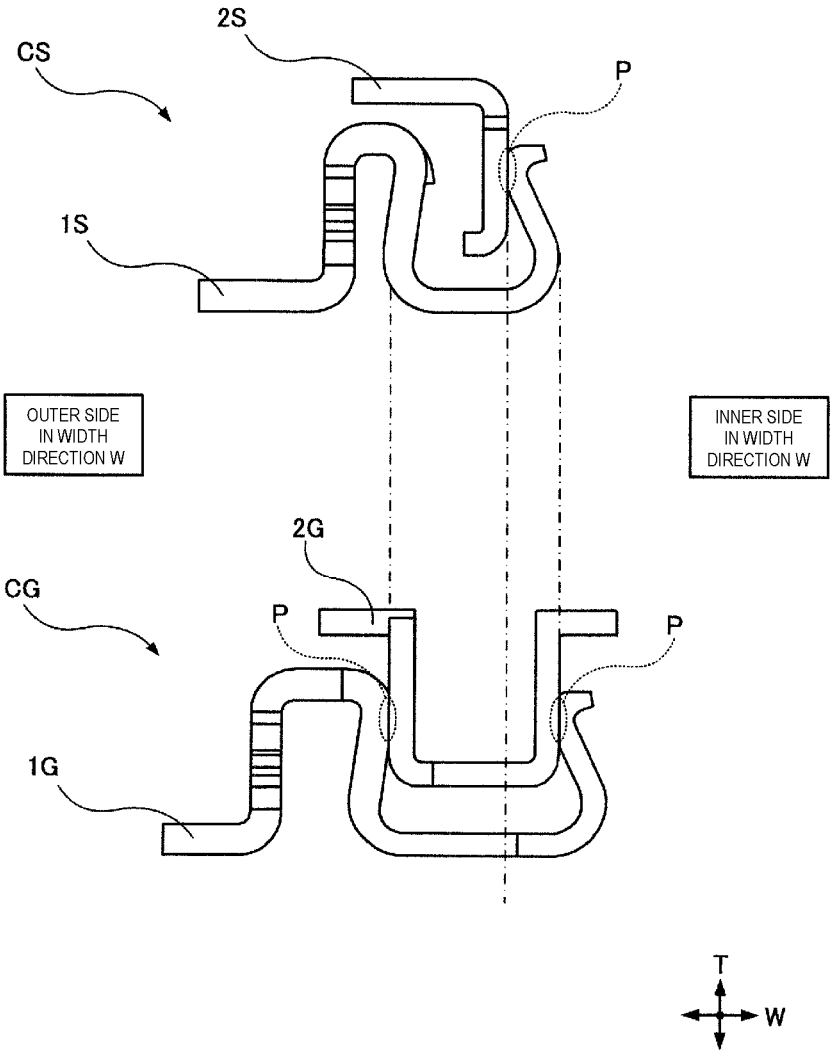
FIG. 11 is a side view illustrating a signal terminal assembly and a ground terminal assembly.

FIG. 11 illustrates a side view of the signal terminal assembly CS and the ground terminal assembly CG. Alternate long and short dash auxiliary lines are illustrated in FIG. 11 to indicate the positional relationship in the width direction W between the signal terminal assembly CS and the ground terminal assembly CG.

As illustrated in FIG. 11, the first signal terminal 1S is connected to the second signal terminal 2S with one connection portion P in the signal terminal assembly CS.

In contrast, the first ground terminal 1G is connected to the second ground terminal 2G with two connection portions P in the ground terminal assembly CG.

As illustrated by the auxiliary lines, the connection portion P of the signal terminal assembly CS is arranged between the connection portion P at the outer side in the width direction W of the ground terminal assembly CG and the connection portion P at the inner side in the width direction W of the ground terminal assembly CG.

Figure 12:
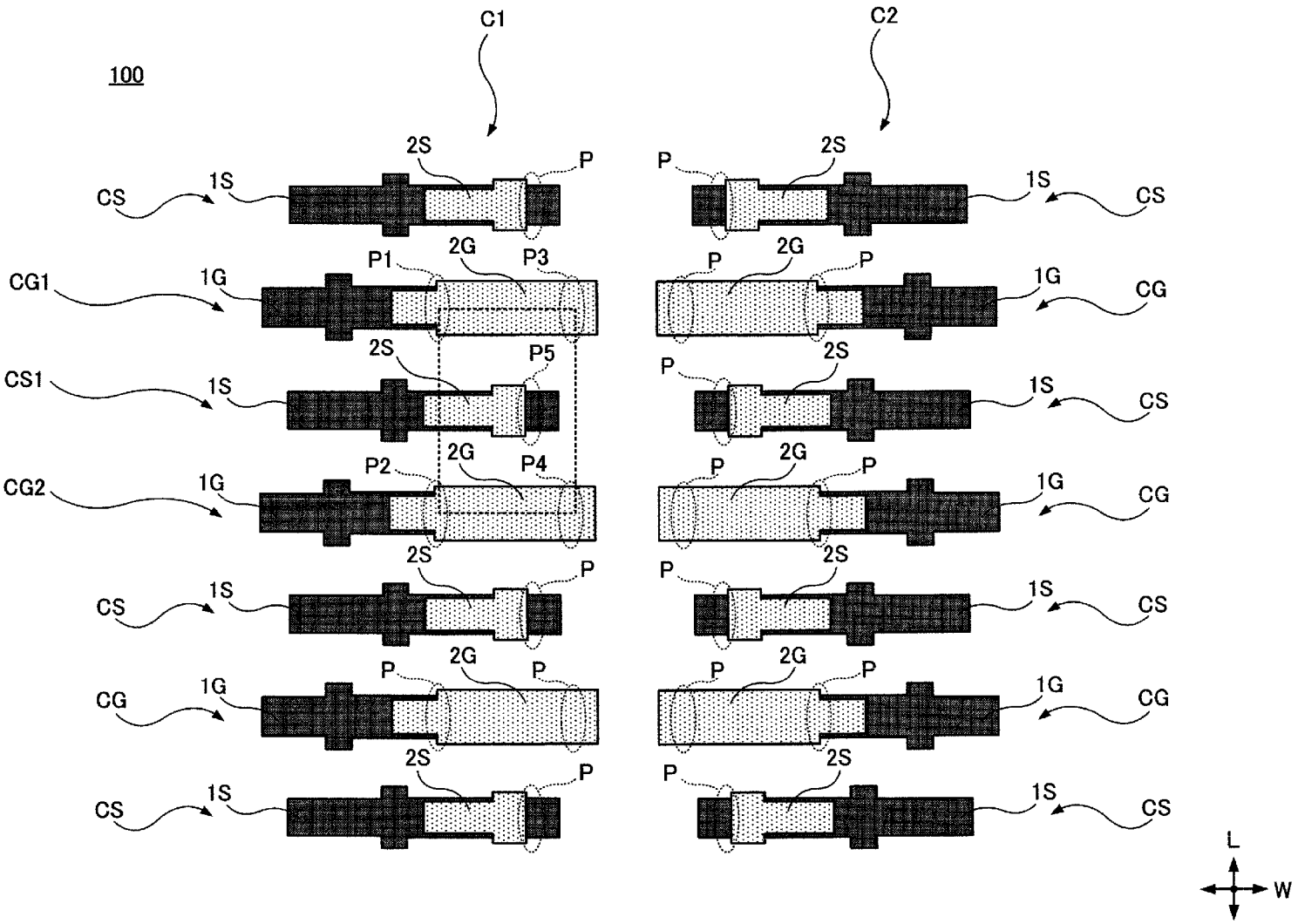
FIG. 12 is an explanatory diagram illustrating how the signal terminal assemblies and the signal terminal assemblies are arranged in the multipole connector set.

FIG. 12 illustrates how the signal terminal assemblies CS and the ground terminal assembly CG are arranged in the multipole connector set 100 when the multipole connector set 100 is viewed from the height direction T.

As illustrated in FIG. 12, one first ground terminal assembly CG1 selected from the ground terminal assemblies CG, one first signal terminal assembly CS1 selected from the signal terminal assemblies CS, and another second ground terminal assembly CG2 selected from the ground terminal assemblies CG are arranged in this order in the first column C1 extending in the length direction L.

The connection portion arranged at the outermost side in the width direction W of the first ground terminal assembly CG1 is referred to as a first connection portion P1, the connection portion arranged at the outermost side in the width direction W of the second ground terminal assembly CG2 is referred to as a second connection portion P2, the connection portion arranged at the innermost side in the width direction W of the first ground terminal assembly CG1 is referred to as a third connection portion P3, the connection portion arranged at the innermost side in the width direction W of the second ground terminal assembly CG2 is referred to as a fourth connection portion P4, and the connection portion of the first signal terminal assembly CS1 is referred to as a fifth connection portion P5.

As illustrated in FIG. 12, the fifth connection portion P5 is arranged inside a quadrangle formed by connecting the first connection portion P1, the second connection portion P2, the third connection portion P3, and the fourth connection portion P4.

The fifth connection portion P5 of the first signal terminal assembly CS1 is arranged inside a line connecting the first connection portion P1 to the second connection portion P2 in the width direction W. Accordingly, the shielding performance outside the first signal terminal assembly CS1 in the width direction W is improved in the multipole connector set 100. In other words, intrusion of noise from the outside into the first signal terminal assembly CS1 and radiation of noise from the first signal terminal assembly CS1 to the outside are suppressed in the multipole connector set 100.

In addition, the fifth connection portion P5 of the first signal terminal assembly CS1 is arranged outside a line connecting the third connection portion P3 to the fourth connection portion P4 in the width direction W in the multipole connector set 100. Accordingly, the shielding performance inside the first signal terminal assembly CS1 in the width direction W is improved in the multipole connector set 100. In other words, the interference of electromagnetic waves between the first signal terminal assembly CS1 and another signal terminal assembly CS arranged in the second column C2 is suppressed in the multipole connector set 100.

Furthermore, the first signal terminal 1S is connected to the second signal terminal 2S with one connection portion P in the signal terminal assembly CS in the multipole connector set 100. Accordingly, the signal terminal assembly CS has a small inductance component in the multipole connector set 100. As a result, in the multipole connector set 100, the resonance point of LC resonance occurring in the signal terminal assembly CS is shifted to a higher frequency side of a signal frequency and the influence of the LC resonance of the signal terminal assembly CS on signals is suppressed. The multiple signal terminal assemblies CS may be arranged so as to be adjacent to each other in the length direction L depending on the shielding performance that is required.

Furthermore, the center shielding members 4 are arranged between the first column C1 and the second column C2 in the multipole connector set 100, the isolation between the signal terminal assemblies CS composed in the first column C1 and the signal terminal assemblies CS composed in the second column C2 is improved.

SECOND EMBODIMENT; MULTIPOLE CONNECTOR SET 200

Figure 13A:
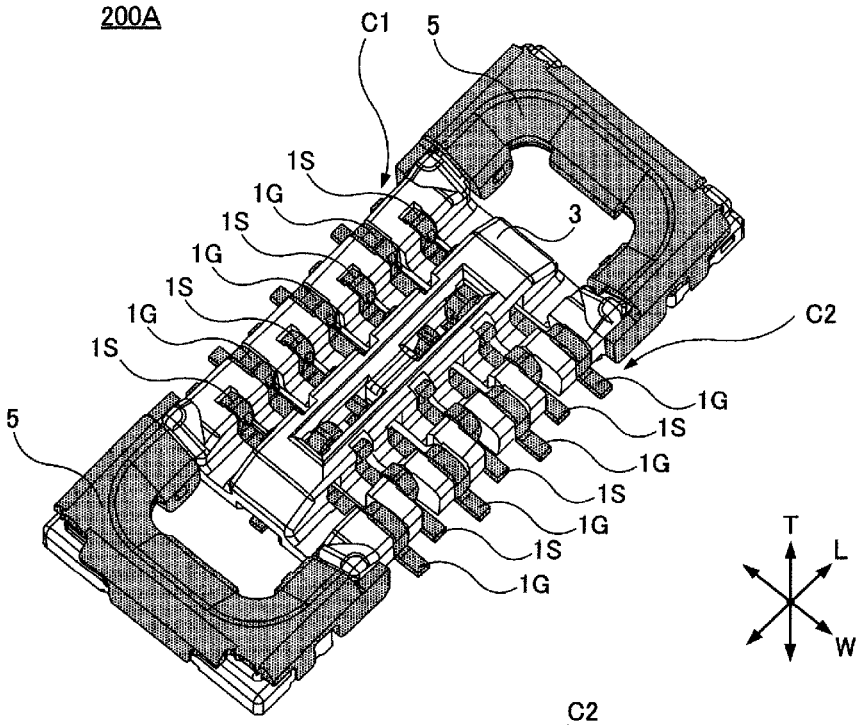
FIG. 13A is a perspective view of a first connector when the first connector is viewed from the mating face side.
Figure 13B:
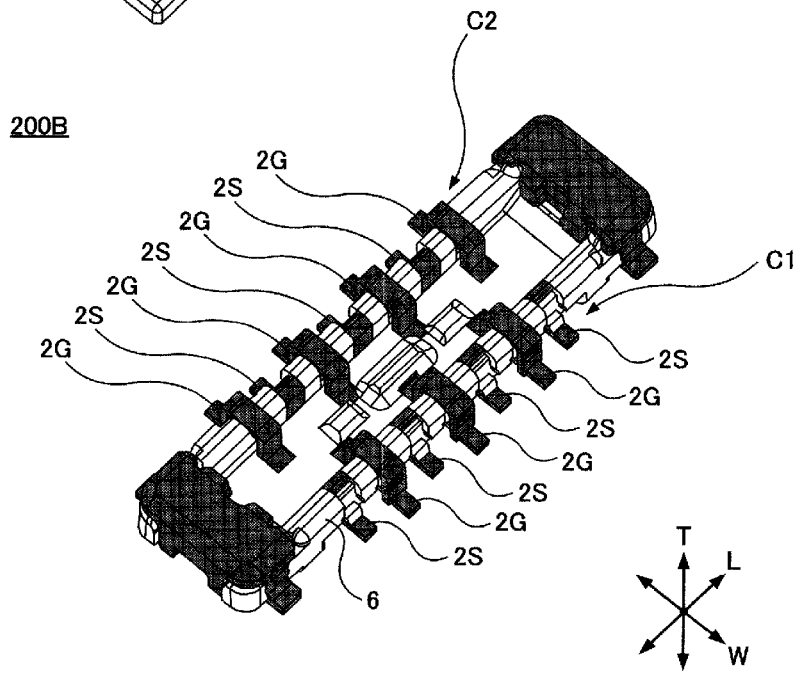
FIG. 13B is a perspective view of a second connector when the second connector is viewed from the mating face side.

FIG. 13A and FIG. 13B illustrate a multipole connector set 200 according to a second embodiment. The multipole connector set 200 is composed by mating a first connector 200A with a second connector 200B. FIG. 13A is a perspective view of the first connector 200A when the first connector 200A is viewed from the mating face side. FIG. 13B is a perspective view of the second connector 200B when the second connector 200B is viewed from the mating face side.

The multipole connector set 200 according to the second embodiment results from addition of changes to part of the configuration of the multipole connector set 100 according to the first embodiment. Specifically, in the first embodiment, the first signal terminals 1S are arranged so as to be opposed to each other and the first ground terminals 1G are arranged so as to be opposed to each other in the width direction W of the first connector 100A. In contrast, in the second embodiment, the first signal terminals 1S and the first ground terminals 1G are arranged so as to be opposed to each other in the width direction W of the first connector 200A. In addition, in the first embodiment, the second signal terminals 2S are arranged so as to be opposed to each other and the second ground terminals 2G are arranged so as to be opposed to each other in the width direction W of the second connector 100B. In contrast, in the second embodiment, the second signal terminals 2S and the second ground terminals 2G are arranged so as to be opposed to each other in the width direction W of the second connector 200B.

The remaining configuration of the multipole connector set 200 is the same as that of the multipole connector set 100.

Figure 14:
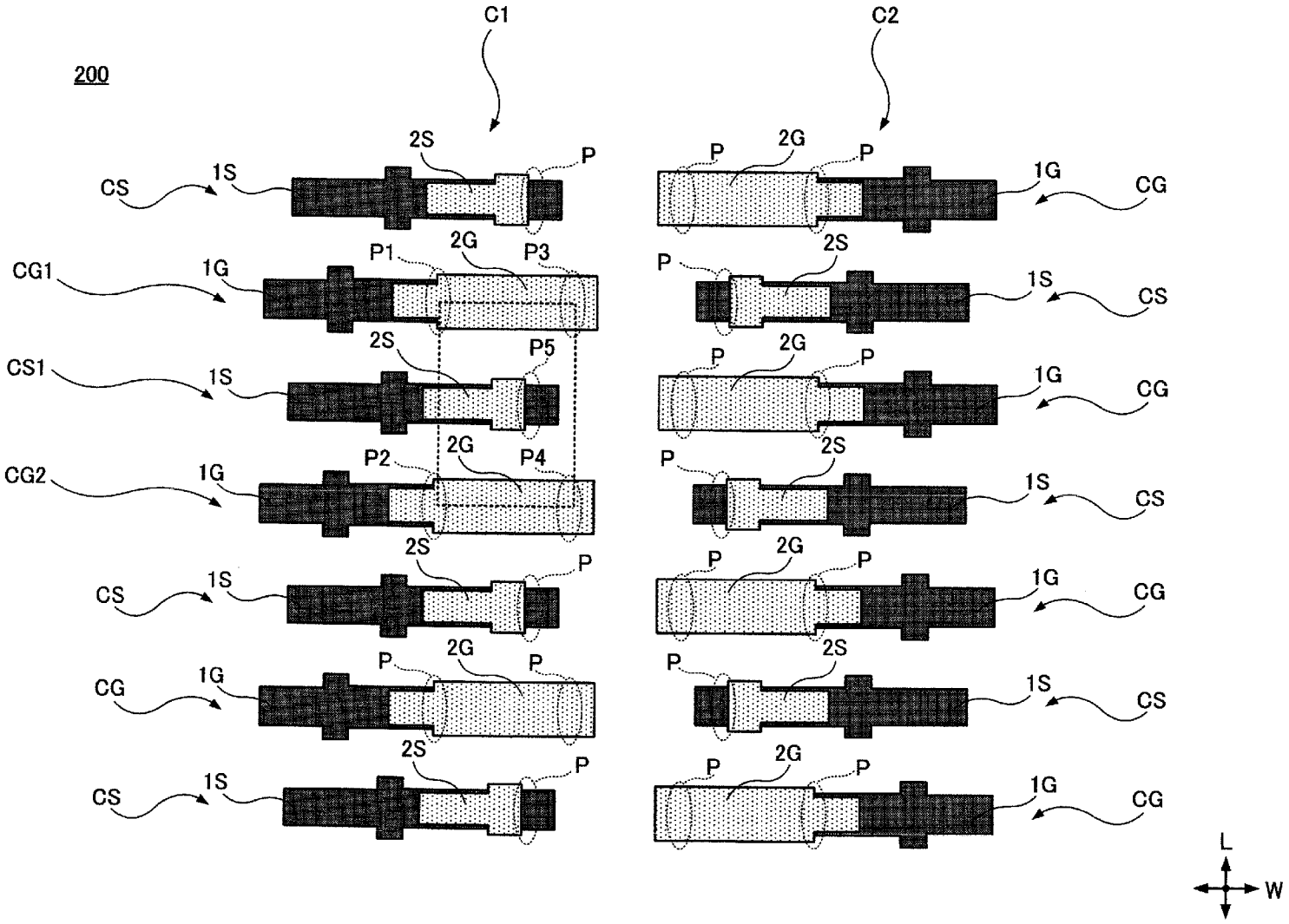
FIG. 14 is an explanatory diagram illustrating how the signal terminal assemblies and the ground terminal assemblies are arranged in the multipole connector set.

As illustrated in FIG. 14, in the second embodiment, each signal terminal assembly CS in the first column C1 and the corresponding ground terminal assembly CG in the second column are aligned in the width direction W to be paired and each ground terminal assembly CG in the first column C1 and the corresponding signal terminal assembly CS in the second column are aligned in the width direction W to be paired. In other words, the signal terminal assemblies CS are not aligned in the width direction W in the first column C1 and the second column C2 and the signal terminal assemblies CS are arranged in a so-called zigzag pattern. The multiple signal terminal assemblies CS may be arranged so as to be adjacent to each other in the length direction L depending on the shielding performance that is required.

In the multipole connector set 200, the interference of electromagnetic waves between the signal terminal assemblies CS arranged in the first column C1 and the signal terminal assemblies CS arranged in the second column C2 is further suppressed.

THIRD EMBODIMENT; MULTIPOLE CONNECTOR SET 300

Figure 15:
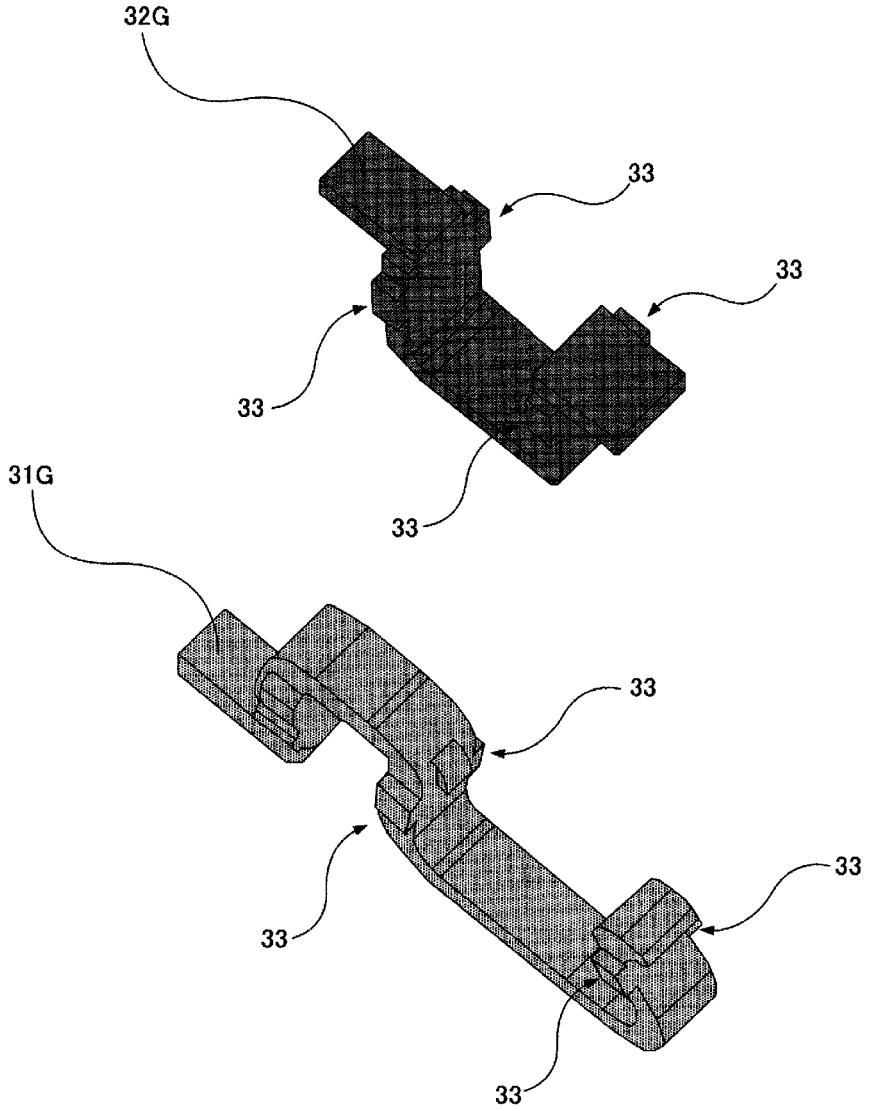
FIG. 15 is a perspective view illustrating a first ground terminal and a second ground terminal in a multipole connector set.
Figure 16:
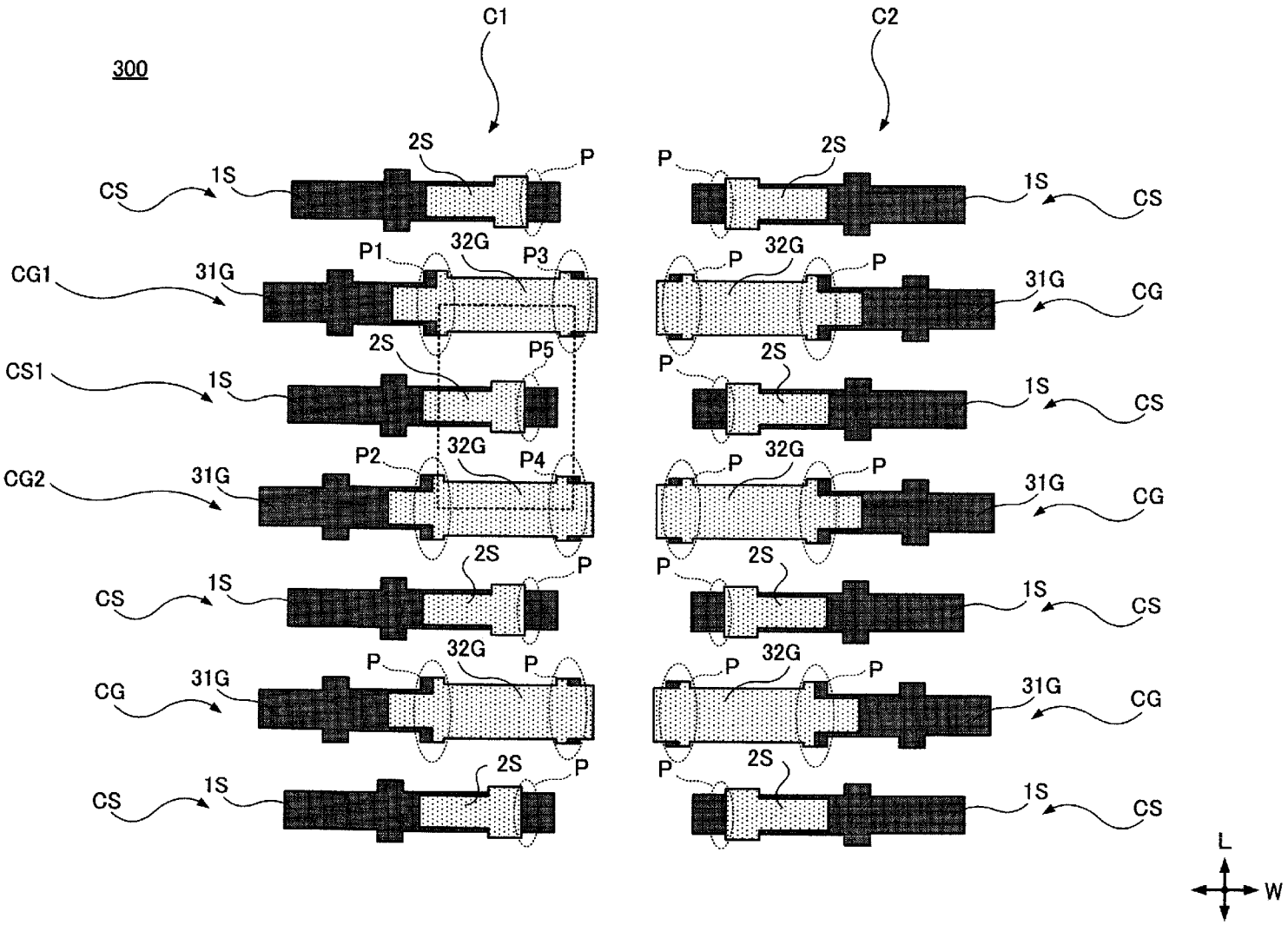
FIG. 16 is an explanatory diagram illustrating how the signal terminal assemblies and the ground terminal assemblies are arranged in the multipole connector set.

FIG. 15 and FIG. 16 illustrate a multipole connector set 300 according to a third embodiment. FIG. 15 is a perspective view illustrating a first ground terminal 31G and a second ground terminal 32G in the multipole connector set 300. FIG. 16 is an explanatory diagram illustrating how the signal terminal assemblies CS and the ground terminal assemblies CG are arranged in the multipole connector set 300.

The multipole connector set 300 results from addition of a change to part of the configuration of the multipole connector set 100 according to the first embodiment. Specifically, the shapes of the first ground terminals 1G and the second ground terminals 2G in the multipole connector set 100 are changed. In each of the first ground terminals 31G and the second ground terminals 32G in the multipole connector set 300, a protrusion 33 is added to the connection portion and the size in the width direction W of the connection portion is larger than that of the remaining portion.

In the multipole connector set 300, the widths of the first connection portion P1, the second connection portion P2, the third connection portion P3, and the fourth connection portion P4 are increased to further improve the shielding performance. In other words, the intrusion of noise from the outside and the radiation of noise to the outside are further suppressed in the multipole connector set 300. In addition, the interference of electromagnetic waves between the signal terminal assemblies CS arranged in the first column and the signal terminal assemblies CS arranged in the second column is further suppressed in the multipole connector set 300.

The multipole connector sets 100, 200, and 300 according to the first embodiment, the second embodiment, and the third embodiment, respectively, are described above. However, the present disclosure is not limited to the above content and various modifications are available in accordance with the idea of the disclosure.

For example, although the first signal terminal 1S is connected to the second signal terminal 2S with one connection portion P in the signal terminal assembly CS in the above embodiments, the connection portions P of an arbitrary number may be provided. The first signal terminal 1S may be connected to the second signal terminal 2S with two or more connection portions P. In this case, the two or more connection portions for the signal terminals may be preferably arranged inside a quadrangle composed of the connection portions of the two ground terminal assemblies CG.

In addition, although one first signal terminal assembly CS1 is arranged between the first ground terminal assembly CG1 and the second ground terminal assembly CG2 in the above embodiments, two or more first signal terminal assemblies CS1 may be arranged between the first ground terminal assembly CG1 and the second ground terminal assembly CG2.

Furthermore, although the first connectors 100A and 200A are each include the center shielding members 4 in the above embodiments, the center shielding members 4 may be omitted.

The multipole connector set according to an embodiment of the present disclosure is described in "Solution to Problem".

A multipole connector set according to another embodiment of the present disclosure is composed by mating a first connector with a second connector. When a length direction, a width direction, and a height direction that are perpendicular to each other are defined for each of the first connector, the second connector, and the multipole connector set in a state in which the first connector is mated with the second connector. The first connector includes multiple first terminals extended in the width direction and a first insulating member holding the first terminals. The first terminals include first signal terminals connected to signal lines and first ground terminals that are grounded. The second connector includes multiple second terminals extended in the width direction and a second insulating member holding the second terminals, and the second terminals include second signal terminals connected to signal lines and second ground terminals that are grounded. In the state in which the first connector is mated with the second connector, each first signal terminal is connected to the corresponding second signal terminal to compose a signal terminal assembly, each first ground terminal is connected to the corresponding second ground terminal to compose a ground terminal assembly. The first signal terminal is connected to the second signal terminal with at least one connection portion in each signal terminal assembly, and the first ground terminal is connected to the second ground terminal with at least one connection portion in each ground terminal assembly. When the multipole connector set is viewed from the height direction, one first ground terminal assembly selected from the ground terminal assemblies, one or two or more first signal terminal assemblies selected from the signal terminal assemblies, and another second ground terminal assembly selected from the ground terminal assemblies are arranged in the length direction as follows. The connection portion arranged at the outermost side in the width direction of the first ground terminal assembly is referred to as a first connection portion. The connection portion arranged at the outermost side in the width direction of the second ground terminal assembly is referred to as a second connection portion, and all the connection portions of the first signal terminal assemblies are arranged inside a line connecting the first connection portion and the second connection portion in the width direction. In this case, intrusion of noise from the outside and radiation of noise to the outside are suppressed without shielding members provided on side faces of the multipole connector set.

A multipole connector set according to another embodiment of the present disclosure is composed by mating a first connector with a second connector. When a length direction, a width direction, and a height direction that are perpendicular to each other are defined for each of the first connector, the second connector, and the multipole connector set in a state in which the first connector is mated with the second connector. The first connector includes multiple first terminals extended in the width direction and a first insulating member holding the first terminals. The multiple first terminals are allocated in a first column and a second column, which extend in the length direction, the first terminals include first signal terminals connected to signal lines and first ground terminals that are grounded. The second connector includes multiple second terminals extended in the width direction and a second insulating member holding the second terminals. The multiple second terminals are allocated in a first column and a second column, which extend in the length direction, and the second terminals include second signal terminals connected to signal lines and second ground terminals that are grounded. In the state in which the first connector is mated with the second connector, each first signal terminal is connected to the corresponding second signal terminal to compose a signal terminal assembly, each first ground terminal is connected to the corresponding second ground terminal to compose a ground terminal assembly, the first signal terminal is connected to the second signal terminal with at least one connection portion in each signal terminal assembly, and the first ground terminal is connected to the second ground terminal with at least one connection portion in each ground terminal assembly. When the multipole connector set is viewed from the height direction and when one first ground terminal assembly selected from the ground terminal assemblies, one or two or more first signal terminal assemblies selected from the signal terminal assemblies, and another second ground terminal assembly selected from the ground terminal assemblies are arranged in the length direction as follows. The connection portion arranged at the innermost side in the width direction of the first ground terminal assembly is referred to as a third connection portion, and the connection portion arranged at the innermost side in the width direction of the second ground terminal assembly is referred to as a fourth connection portion. All the connection portions of the first signal terminal assemblies are arranged outside a line connecting the third connection portion and the fourth connection portion in the width direction. In this case, the interference of electromagnetic waves between the signal terminal assemblies arranged in the first column and the signal terminal assemblies arranged in the second column is further suppressed.

In the above embodiments, the connection portion preferably has a width larger than that of the remaining portion in each first ground terminal and each second ground terminal. In this case, the shielding performance is further improved.

The first signal terminal is preferably connected to the second signal terminal with one connection portion in each signal terminal assembly. In this case, the effect of LC resonance of the signal terminal assembly on signals is suppressed.

It is preferred that a first external conductor be formed at each end in the length direction of the first connector, a second external conductor be formed at each end in the length direction of the second connector, and the first external conductor be connected to the second external conductor in the state in which the first connector is mated with the second connector. In this case, it is possible to shield end faces of the multipole connector set.

In the first connector, the multiple first terminals are preferably allocated in the first column and the second column, which extend in the length direction. In the second connector, the multiple second terminals are preferably allocated in the first column and the second column, which extend in the length direction. In the state in which the first connector is mated with the second connector, the signal terminal assemblies are preferably composed in each of the first column and the second column, and a center shielding member is preferably arranged between the first column and the second column. In this case, the center shielding member may improve the isolation between the signal terminal assemblies arranged in the first column and the signal terminal assemblies arranged in the second column.

In the first connector, it is preferred that the multiple first terminals be allocated in the first column and the second column, which extend in the length direction, each first signal terminal arranged in the first column and the corresponding first ground terminal arranged in the second column be aligned in the width direction to be paired, and each first ground terminal arranged in the first column and the corresponding first signal terminal arranged in the second column be aligned in the width direction to be paired. In the second connector, it is preferred that the multiple second terminals be allocated in the first column and the second connector, which extend in the length direction, each second signal terminal arranged in the first column and the corresponding second ground terminal arranged in the second column be aligned in the width direction to be paired, and each second ground terminal arranged in the first column and the corresponding second signal terminal arranged in the second column be aligned in the width direction to be paired. In this case, the interference of electromagnetic waves between the signal terminal assemblies arranged in the first column and the signal terminal assemblies arranged in the second column is further suppressed.

What is claimed is:

1. A multipole connector set composed by mating a first connector with a second connector, wherein, when a length direction, a width direction, and a height direction that are perpendicular to each other are defined for each of the first connector, the second connector, and the multipole connector set in a state in which the first connector is mated with the second connector, the first connector includes a plurality of first terminals extended in the width direction and a first insulating member holding the first terminals, the plurality of first terminals is allocated in a first column and a second column, which extend in the length direction, the first terminals include first signal terminals connected to signal lines and first ground terminals that are grounded, the second connector includes a plurality of second terminals extended in the width direction and a second insulating member holding the second terminals, the plurality of second terminals is allocated in a first column and a second column, which extend in the length direction, and the second terminals include second signal terminals connected to signal lines and second ground terminals that are grounded, wherein, in the state in which the first connector is mated with the second connector, each first signal terminal is connected to the corresponding second signal terminal to compose a signal terminal assembly, each first ground terminal is connected to the corresponding second ground terminal to compose a ground terminal assembly, the first signal terminal is connected to the second signal terminal with at least one connection portion in each signal terminal assembly, and the first ground terminal is connected to the second ground terminal with at least two connection portions in each ground terminal assembly, and wherein, when the multipole connector set is viewed from the height direction and when one first ground terminal assembly selected from the ground terminal assemblies, one or two or more first signal terminal assemblies selected from the signal terminal assemblies, and another second ground terminal assembly selected from the ground terminal assemblies are arranged in the length direction as follows:

the connection portion arranged at the outermost side in the width direction of the first ground terminal assembly is referred to as a first connection portion, the connection portion arranged at the outermost side in the width direction of the second ground terminal assembly is referred to as a second connection portion, the connection portion arranged at the innermost side in the width direction of the first ground terminal assembly is referred to as a third connection portion, the connection portion arranged at the innermost side in the width direction of the second ground terminal assembly is referred to as a fourth connection portion, and all the connection portions of the first signal terminal assemblies are arranged inside a quadrangle connecting the first connection portion, the second connection portion, the third connection portion, and the fourth connection portion.

2. A multipole connector set composed by mating a first connector with a second connector, wherein, when a length direction, a width direction, and a height direction that are perpendicular to each other are defined for each of the first connector, the second connector, and the multipole connector set in a state in which the first connector is mated with the second connector, the first connector includes a plurality of first terminals extended in the width direction and a first insulating member holding the first terminals, the first terminals include first signal terminals connected to signal lines and first ground terminals that are grounded, the second connector includes a plurality of second terminals extended in the width direction and a second insulating member holding the second terminals, and the second terminals include second signal terminals connected to signal lines and second ground terminals that are grounded, wherein, in the state in which the first connector is mated with the second connector, each first signal terminal is connected to the corresponding second signal terminal to compose a signal terminal assembly, each first ground terminal is connected to the corresponding second ground terminal to compose a ground terminal assembly, the first signal terminal is connected to the second signal terminal with at least one connection portion in each signal terminal assembly, and the first ground terminal is connected to the second ground terminal with at least one connection portion in each ground terminal assembly, and wherein, when the multipole connector set is viewed from the height direction, one first ground terminal assembly selected from the ground terminal assemblies, one or two or more first signal terminal assemblies selected from the signal terminal assemblies, and another second ground terminal assembly selected from the ground terminal assemblies are arranged in the length direction as follows:

the connection portion arranged at the outermost side in the width direction of the first ground terminal assembly is referred to as a first connection portion, the connection portion arranged at the outermost side in the width direction of the second ground terminal assembly is referred to as a second connection portion, and all the connection portions of the first signal terminal assemblies are arranged inside a line connecting the first connection portion and the second connection portion in the width direction.

3. A multipole connector set composed by mating a first connector with a second connector, wherein, when a length direction, a width direction, and a height direction that are perpendicular to each other are defined for each of the first connector, the second connector, and the multipole connector set in a state in which the first connector is mated with the second connector, the first connector includes a plurality of first terminals extended in the width direction and a first insulating member holding the first terminals, the plurality of first terminals is allocated in a first column and a second column, which extend in the length direction, the first terminals include first signal terminals connected to signal lines and first ground terminals that are grounded, the second connector includes a plurality of second terminals extended in the width direction and a second insulating member holding the second terminals, the plurality of second terminals is allocated in a first column and a second column, which extend in the length direction, and the second terminals include second signal terminals connected to signal lines and second ground terminals that are grounded, wherein, in the state in which the first connector is mated with the second connector, each first signal terminal is connected to the corresponding second signal terminal to compose a signal terminal assembly, each first ground terminal is connected to the corresponding second ground terminal to compose a ground terminal assembly, the first signal terminal is connected to the second signal terminal with at least one connection portion in each signal terminal assembly, and the first ground terminal is connected to the second ground terminal with at least one connection portion in each ground terminal assembly, and wherein, when the multipole connector set is viewed from the height direction and when one first ground terminal assembly selected from the ground terminal assemblies, one or two or more first signal terminal assemblies selected from the signal terminal assemblies, and another second ground terminal assembly selected from the ground terminal assemblies are arranged in the length direction as follows:

the connection portion arranged at the innermost side in the width direction of the first ground terminal assembly is referred to as a third connection portion, the connection portion arranged at the innermost side in the width direction of the second ground terminal assembly is referred to as a fourth connection portion, and all the connection portions of the first signal terminal assemblies are arranged outside a line connecting the third connection portion and the fourth connection portion in the width direction.

4. The multipole connector set according to claim 1, wherein the connection portion has a width larger than that of a remaining portion in each first ground terminal and each second ground terminal.

5. The multipole connector set according to claim 1, wherein the first signal terminal is connected to the second signal terminal with one connection portion in each signal terminal assembly.

6. The multipole connector set according to claim 1, wherein a first external conductor is formed at each end in the length direction of the first connector, a second external conductor is formed at each end in the length direction of the second connector, and the first external conductor is connected to the second external conductor in the state in which the first connector is mated with the second connector.

7. The multipole connector set according to claim 1, wherein in the first connector, the plurality of first terminals is allocated in the first column and the second column, which extend in the length direction, in the second connector, the plurality of second terminals is allocated in the first column and the second column, which extend in the length direction, and in the state in which the first connector is mated with the second connector, the signal terminal assemblies are composed in each of the first column and the second column, and a center shielding member is arranged between the first column and the second column.

8. The multipole connector set according to claim 1, wherein in the first connector, the plurality of first terminals is allocated in the first column and the second column, which extend in the length direction, each first signal terminal arranged in the first column and the corresponding first ground terminal arranged in the second column are aligned in the width direction to be paired, and each first ground terminal arranged in the first column and the corresponding first signal terminal arranged in the second column are aligned in the width direction to be paired, and in the second connector, the plurality of second terminals is allocated in the first column and the second connector, which extend in the length direction, each second signal terminal arranged in the first column and the corresponding second ground terminal arranged in the second column are aligned in the width direction to be paired, and each second ground terminal arranged in the first column and the corresponding second signal terminal arranged in the second column are aligned in the width direction to be paired.

9. The multipole connector set according to claim 2, wherein the connection portion has a width larger than that of a remaining portion in each first ground terminal and each second ground terminal.

10. The multipole connector set according to claim 3, wherein the connection portion has a width larger than that of a remaining portion in each first ground terminal and each second ground terminal.

11. The multipole connector set according to claim 2, wherein the first signal terminal is connected to the second signal terminal with one connection portion in each signal terminal assembly.

12. The multipole connector set according to claim 3, wherein the first signal terminal is connected to the second signal terminal with one connection portion in each signal terminal assembly.

13. The multipole connector set according to claim 4, wherein the first signal terminal is connected to the second signal terminal with one connection portion in each signal terminal assembly.

14. The multipole connector set according to claim 2, wherein a first external conductor is formed at each end in the length direction of the first connector, a second external conductor is formed at each end in the length direction of the second connector, and the first external conductor is connected to the second external conductor in the state in which the first connector is mated with the second connector.

15. The multipole connector set according to claim 3, wherein a first external conductor is formed at each end in the length direction of the first connector, a second external conductor is formed at each end in the length direction of the second connector, and the first external conductor is connected to the second external conductor in the state in which the first connector is mated with the second connector.

16. The multipole connector set according to claim 4, wherein a first external conductor is formed at each end in the length direction of the first connector, a second external conductor is formed at each end in the length direction of the second connector, and the first external conductor is connected to the second external conductor in the state in which the first connector is mated with the second connector.

17. The multipole connector set according to claim 2, wherein in the first connector, the plurality of first terminals is allocated in the first column and the second column, which extend in the length direction, in the second connector, the plurality of second terminals is allocated in the first column and the second column, which extend in the length direction, and in the state in which the first connector is mated with the second connector, the signal terminal assemblies are composed in each of the first column and the second column, and a center shielding member is arranged between the first column and the second column.

18. The multipole connector set according to claim 3, wherein in the first connector, the plurality of first terminals is allocated in the first column and the second column, which extend in the length direction, in the second connector, the plurality of second terminals is allocated in the first column and the second column, which extend in the length direction, and in the state in which the first connector is mated with the second connector, the signal terminal assemblies are composed in each of the first column and the second column, and a center shielding member is arranged between the first column and the second column.

19. The multipole connector set according to claim 2, wherein in the first connector, the plurality of first terminals is allocated in the first column and the second column, which extend in the length direction, each first signal terminal arranged in the first column and the corresponding first ground terminal arranged in the second column are aligned in the width direction to be paired, and each first ground terminal arranged in the first column and the corresponding first signal terminal arranged in the second column are aligned in the width direction to be paired, and in the second connector, the plurality of second terminals is allocated in the first column and the second connector, which extend in the length direction, each second signal terminal arranged in the first column and the corresponding second ground terminal arranged in the second column are aligned in the width direction to be paired, and each second ground terminal arranged in the first column and the corresponding second signal terminal arranged in the second column are aligned in the width direction to be paired.

20. The multipole connector set according to claim 2, wherein in the first connector, the plurality of first terminals is allocated in the first column and the second column, which extend in the length direction, each first signal terminal arranged in the first column and the corresponding first ground terminal arranged in the second column are aligned in the width direction to be paired, and each first ground terminal arranged in the first column and the corresponding first signal terminal arranged in the second column are aligned in the width direction to be paired, and in the second connector, the plurality of second terminals is allocated in the first column and the second connector, which extend in the length direction, each second signal terminal arranged in the first column and the corresponding second ground terminal arranged in the second column are aligned in the width direction to be paired, and each second ground terminal arranged in the first column and the corresponding second signal terminal arranged in the second column are aligned in the width direction to be paired.

* * * * *